United States Patent [19]

Westcott

[11] 4,225,064

[45] Sep. 30, 1980

[54] PAINTER'S ACCESSORY

[76] Inventor: Richard Westcott, 3200 Main Ave., Clear Lake, Iowa 50428

[21] Appl. No.: 6,349

[22] Filed: Jan. 25, 1979

[51] Int. Cl.[2] ..... B65D 5/74; B65D 25/48

[52] U.S. Cl. ..... 222/569; 220/90; 222/570

[58] Field of Search ..... 222/192, 567, 569, 570; 220/85 SP, 90

[56] References Cited

U.S. PATENT DOCUMENTS

| | | | |
|---|---|---|---|
| 297,317 | 4/1884 | Thurber . | |
| 1,153,320 | 9/1915 | Klenck . | |
| 1,547,541 | 7/1925 | Wansner . | |
| 2,867,403 | 1/1959 | Graf . | |
| 2,903,154 | 9/1959 | Hendershot . | |
| 3,016,169 | 1/1962 | Kirshenbaum | 222/192 |
| 3,221,955 | 12/1965 | Banaszak et al. | 222/570 |
| 3,239,113 | 3/1966 | Knize | 222/569 |
| 3,298,561 | 1/1967 | McConnie | 220/90 |
| 3,972,453 | 8/1976 | Kapples | 222/570 X |
| 3,980,213 | 9/1976 | Ramsay | 222/570 X |

*Primary Examiner*—David A. Scherbel
*Assistant Examiner*—Fred A. Silverberg
*Attorney, Agent, or Firm*—Merchant, Gould, Smith, Edell, Welter & Schmidt

[57] ABSTRACT

The invention comprises a body (11) of slightly elastic material having an inner wall (13) and an outer wall (14) spaced by a generally radial interconnecting web (15) from which the walls project in the same axial direction. A sealing ridge (20) projects from the inner wall toward the outer wall, spaced axially from the web and extending peripherally for predetermined distances in both directions from a predetermined angular location around the annulus. A pouring lip (50) and a service lip (40) comprise outward and inward extensions of the web respectively, and are centered at opposite ends of a diameter passing through the predetermined location: both lips are of limited angular extent.

2 Claims, 5 Drawing Figures

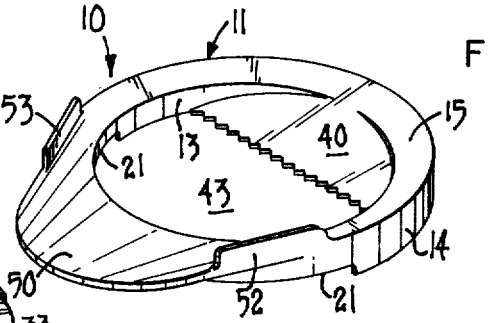
FIG. 1
FIG. 5
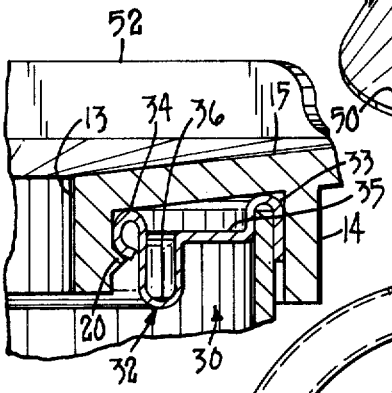
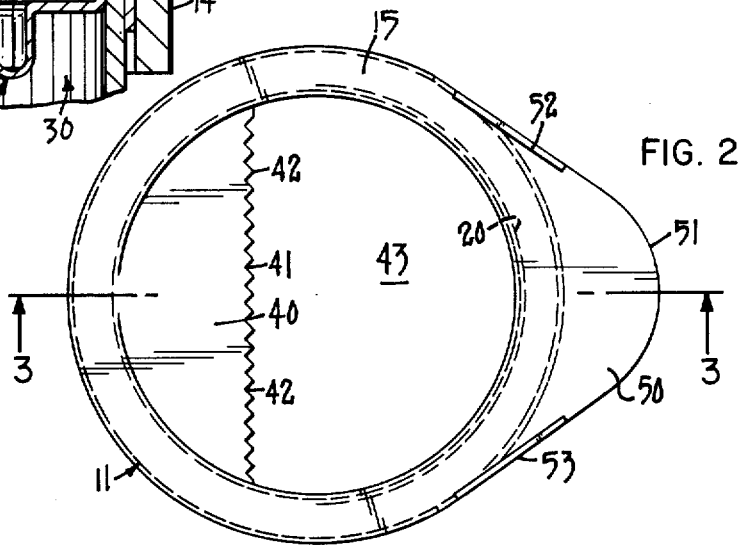
FIG. 2
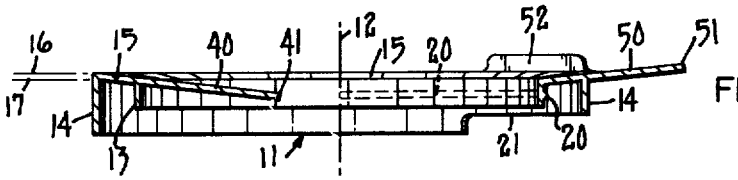
FIG. 3
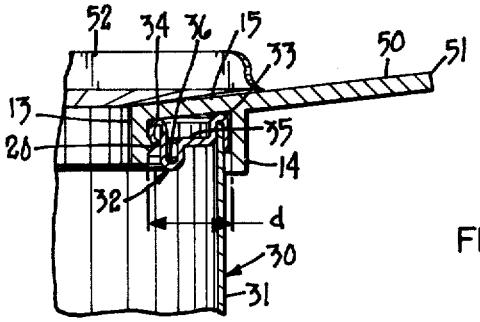
FIG. 4

PAINTER'S ACCESSORY

BACKGROUND OF THE INVENTION

This invention relates generally to the mechanic arts, and more particularly to accessories for use by painters to facilitate several of the operations repetitively performed in the process of painting.

As is well known, painting is in practical terms the transfer of liquid paint from a container to a surface to be painted, the transfer being accomplished by such tools as brushes or, more recently, rollers. Paint is supplied in containers or cans of the type which has a plug-in top, and a bail-type handle as well in the larger sizes. It is notoriously well known that the pigment settles to the bottom of the can upon standing, beneath a layer of clear vehicle. The individual steps in painting are opening the can, remixing the pigment and vehicle, carrying the mixed paint in the can to the site of use, dipping a brush into the paint, removing it, wiping off excess paint, brushing the paint on the surface to be covered, and repeating the dipping, wiping and brushing step until the surface is completely covered, the painter moving with the can of paint, as necessary, during this process. Ascent and decent of ladders, repositioning of ladders and planks, amelioration of the surface being painted, and simple manual fatigue present frequent ocassions for the brush to be released, which must be accomplished without transfer of paint from the brush to unintended surfaces. There is often need to pour paint from its supply can into some other container.

It is conventional to pour paint directly from the can, and to wipe a loaded brush by rubbing it against the inner rim of the can top, both of which processes quickly fill the groove in the can top with paint and then cause paint to run down the outside of the can, to result in undesirable dripping. It is also conventional to rest the brush across the top of the can, where its handle becomes smeared with any paint in the groove which is subsequently transferred to the painter's hand or glove when the brush is again taken up.

SUMMARY OF THE INVENTION

This invention comprises an accessory which is removably attachable to the open tops of paint cans, and which when so attached facilitates the pouring, wiping, and brush storage activities by completely controlling the paint so that there is no groove filled with liquid paint around the top of the can, and no rundown of paint on the side of the can even after pouring paint therefrom. The accessory includes a portion usable to wipe excess paint from the brush so that it all returns into the can, and also makes available a location where the brush handle can be laid without encountering paint.

The accessory comprises an annulus of slightly elastic material having an inner wall and an outer wall spaced by a generally radial interconnecting web from which the walls project in the same axial direction. The spacing between the walls corresponds to the width of the rim of a paint can, and a sealing ridge projects from the inner wall toward the outer wall, spaced axially from the web by the thickness of the rim of a can, and extending peripherally for predetermined distances in both directions from a predetermined angular location around the annulus. A pouring lip and a service lip comprise outward and inward extensions of the web respectively, and are centered at opposite ends of a diameter passing through the predetermined location: both lips are of limited angular extent. The pouring lip includes a pair of ridges converging outwardly but not intersecting, to guide the flow of paint poured across the lip, and the service lip has a generally straight, serrated inner edge to facilitate wiping excess paint from a brush which has just been dipped into the can. It is contemplated for the accessory to be made available in sizes to fit the standard sizes of paint cans.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, FIG. 1 is a perspective view of an embodiment of the invention;

FIG. 2 is a plan view of the invention to a larger scale;

FIG. 3 is a sectional view along the diameter 3—3 of FIG. 2;

FIG. 4 is a fragmentary sectional view of a portion of the invention when applied to the top of a can, to a still larger scale; and FIG. 5 is a greatly enlarged detailed sectional view corresponding to a portion of FIG. 4.

DESCRIPTION OF THE PREFERRED EMBODIMENT

As shown in the drawing, my invention is a painter's accessory 10 comprising a body 11 of at least slightly elastic material, such as a suitable plastic which is resistant to attack by the vehicle of the paint. Body 11 is generally annular about an axis 12, and comprises an inner wall 13 and an outer wall 14, both relatively thin and of generally cylindrical configuration, spaced by a generally radial interconnecting web 15, also relatively thin, from which the walls project in the same axial direction. Web 15 is not flat, but generally comprises the segment, of a right circular cone on axis 12 having a large apex angle, between spaced truncation planes 16 and 17 perpendicular to the axis.

A sealing ridge 20 projects from inner wall 13 toward outer wall 14 for approximately half the circumference of the accessory centered on diameter 3—3. Outer wall 14 is partially cut away to form a notch 21, for a smaller angle also centered on diameter 3—3. The dimensions of the parts so far described will become more apparent from FIG. 4, which shows a portion of a can 30 having a wall 31 and a rim 32 comprising an outer bead 33 and an inner bead 34 interconnected by a flat ring 35 having a groove 36: this is the usual construction of plug-in top cans in which paint is supplied. The space d between walls 13 and 14 is determined by the dimension of rim 32, to resiliently secure the accessory to the can, ridge 20 being spaced axially from web 15 to snugly engage bead 34 and prevent passage of paint therebetween when the can is tilted for pouring. Application of the accessory to a can and its removal therefrom are facilitated by the presence of notch 21.

Web 15 is inwardly extended to form a service lip 40, terminating in a generally straight edge 41 having serrations 42. Lip 40 preferably approximates a plane tangent to the conical surface of the web at diameter 3—3, rather than comprising an inward continuance of the conical surface. It projects inwardly for less than half the diameter of the accessory, to leave a large space 43 through which a brush may be dipped into paint in a can below, while ensuring that paint wiped off an overfull brush falls into the can.

Web 15 is outwardly extended to form a pouring lip 50, which preferably forms a continuation of the conical surface, so that any paint remaining on lip 50 tends to flow back into the can. The outer edge 51 of lip 50 is rounded, and the lip includes a pair of ridges 52 and 53 which converge toward edge 51 but do not intersect, to leave pouring space therebetween. It is to be noted that preferably lips 40 and 50 are each bilaterally symmetrical about diameter 3—3, as are ridge 20 and notch 21.

USE

In using my invention, an accessory for use is chosen to fit the size of the paint container to be used. A can is opened, and if the paint is to be mixed by stirring the stirring is accomplished. If the paint is to be mixed by "boxing" that is, by being poured back and forth between a pair of containers, the accessory is applied to the can immediately, and pressed well down so that wall 13 and 14 engage rim 32, and ridge 20 seals itself below bead 34 of the can. Now when the can is tilted toward lip 50, paint flows over inner wall 13, web 15, and lip 50, but cannot flow past ridge 20 and bead 34 into groove 36. When the can is returned to the vertical and any drop of paint remaining at edge 51 of lip 50 is removed, paint remaining on lip 50 runs back into the can. If the can is one with a bail, the direction of the bail pivot is preferably orthogonal to that of diameter 3—3.

When actual painting is begun the painter dips his brush into the can through space 43 to charge it with paint, raises the brush, wipes off excess paint by drawing the brush upward across serrations 42 of lip 40, and transfers the paint to the surface being painted. If he has occasion, the painter may lay his brush across the top of the can, with the bristles resting on lip 50 and the handle resting on web 15, well above the edge 41 of lip 40 and thus free from contact with wet paint.

From the foregoing it will be clear that I have invented a painter's accessory for removable mounting on an open paint can, to enable brush wiping, temporary brush support, and even pouring from the can while preventing undesired movement of paint into the rim or onto the surface of the can or the handle of a brush.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A can top accessory of at least slightly elastic material comprising an annular body having an axis and including an inner wall and an outer wall spaced by a generally radial interconnecting web from which said walls project in the same direction, said walls being defined by closed circular cylindrical surfaces and said outer wall being of greater axial extent than said inner wall, said inner wall being of substantially uniform axial extent and said outer being of substantially uniform axial extent except for a notch extending, in both directions from a predetermined axial location about said axis, around less than half the circumference of said outer wall, and said web defining the segment, of a circular cone having a large apex angle, between spaced truncating planes perpendicular to said axis;

a sealing ridge projecting toward said outer wall from said inner wall, spaced axially from said web and extending in both directions from said predetermined angular location around substantially half the circumference of said inner wall;

and a pouring lip comprising an outward radial extension of said web in said cone, of limited extent radially and of limited angular extent about said predetermined location.

2. A can top accessory according to claim 1, and a service lip comprising an inward extension of said web defining a plane tangent to said cone, of limited extent radially and of angular extent, about said axis, centered at a location opposite said predetermined location, said service lip terminating inwardly in a straight line orthogonal to said axis and nearer the apex of said cone than said truncation plane.

* * * * *